US008475035B1

(12) United States Patent
Harrington

(10) Patent No.: US 8,475,035 B1
(45) Date of Patent: Jul. 2, 2013

(54) MOUNTABLE TIMEPIECE FOR HUNTING

(76) Inventor: Cindy Harrington, Geneseo, IL (US)

( * ) Notice: Subject to any disclaimer, the term of this patent is extended or adjusted under 35 U.S.C. 154(b) by 259 days.

(21) Appl. No.: 12/973,982

(22) Filed: Dec. 21, 2010

(51) Int. Cl.
*G04B 37/00* (2006.01)

(52) U.S. Cl.
USPC ..... 368/277; 368/278; 224/177

(58) Field of Classification Search
USPC ..... 368/277, 281, 282, 278; 224/167, 224/175, 164
See application file for complete search history.

(56) References Cited

U.S. PATENT DOCUMENTS

| | | | | | |
|---|---|---|---|---|---|
| 2,009,253 | A * | 7/1935 | Feld et al. | ..... | 224/174 |
| 3,361,311 | A * | 1/1968 | Sartarelli | ..... | 224/176 |
| D243,318 | S | 2/1977 | Kurihara | | |
| 4,060,185 | A | 11/1977 | Kuroda | | |
| 4,155,219 | A * | 5/1979 | Anderson | ..... | 368/282 |
| 4,266,326 | A * | 5/1981 | Hong | ..... | 24/265 WS |
| 4,326,280 | A * | 4/1982 | Perry, Jr. | ..... | 368/277 |
| 4,779,249 | A * | 10/1988 | Rappaport | ..... | 368/276 |
| 5,898,647 | A * | 4/1999 | Goradesky | ..... | 368/83 |
| 5,917,780 | A * | 6/1999 | Berestov | ..... | 368/282 |
| 6,234,668 | B1 * | 5/2001 | Cooper | ..... | 368/281 |
| D455,969 | S | 4/2002 | Wilson | | |
| 2007/0153639 | A1 * | 7/2007 | Lafever et al. | ..... | 368/282 |
| 2007/0220919 | A1 * | 9/2007 | Loetscher et al. | ..... | 63/3.2 |
| 2008/0049560 | A1 | 2/2008 | Clarkson et al. | | |

* cited by examiner

*Primary Examiner* — Vit W Miska
*Assistant Examiner* — Matthew Powell
(74) *Attorney, Agent, or Firm* — Montgomery Patent & Design; Robert C. Montgomery

(57) ABSTRACT

A wrist watch-style timepiece includes a means for secure mounting onto a variety of common hunting weapons, such as a rifle, a crossbow, a shotgun or a bow. The mounting members are envisioned to include a variety of straps and closures configured to accommodate the selected type of weapon and to be connected to the timepiece by mounting collars. The timepiece is intended to show the time in a glow-in-the-dark display in a user's line of sight, thereby avoiding any rustling sounds associated with consulting a wrist watch or pocket timepiece.

20 Claims, 8 Drawing Sheets

MOUNTABLE TIMEPIECE FOR HUNTING

RELATED APPLICATIONS

The present invention was first described in a notarized Official Record of Invention on Mar. 8, 2010, that is on file at the offices of Montgomery Patent and Design, LLC, the entire disclosures of which are incorporated herein by reference.

FIELD OF THE INVENTION

The present invention relates generally to hunting equipment, and in particular, to timepiece and mountable band adapted to be connected to a weapon such that the timepiece is positioned in the line-of-sight of a user during aiming or firing of the weapon.

BACKGROUND OF THE INVENTION

There are a large number of hunting regulations that are in place to ensure the safety of hunters as well as for the preservation of the animal species being hunted. One (1) important regulation which is often overlooked is that of appropriate hunting times during the day. Whether from certain hours or based upon dusk to dawn hours, hunters must make sure that they do not shoot their rifle or fire their bow outside of these hours. Many resort to a wrist watch to ensure compliance. However, the constant checking of a wrist watch leads to unwelcome movement, noise, and rustling that can spook the hunted animal, leading to the loss of a great shot. This problem is caused due to the wrist watch not being easily viewable from a ready or firing position.

SUMMARY OF THE INVENTION

The inventor has therefore recognized the aforementioned inherent problems and lack in the art and observed that there is a need for a device by which hunters can be kept aware of the current time of the day by mounting a timepiece in the hunter's visual line-of-sight without the disadvantages as described above. It is an object of the present disclosure to solve these problems.

The inventor recognized these problems and has addressed this need by developing a mountable timepiece for hunting weapons which provides hunters an easy way to be kept aware of the current time to allow for lawful compliance of hunting regulations in a manner which quick, easy, and effective. The inventor has thus realized the advantages and benefits of providing a timepiece adapted to be connected to a projectile weapon such that the timepiece is positioned in the line-of-sight of the user during the aiming and firing of the weapon. The timepiece indicates the time of day and includes at least a timepiece frame body, a watch mechanism housed within the frame body, a display, a pair of lugs disposed on opposing ends of a top side and a bottom side of the timepiece frame. An open area is defined between each pair lugs. A mounting strap is provides having an elongated flexible body including an upper and a lower surface and a front end and an opposing rear end. A pair of mounting collars is affixed to opposing edges of the upper surface transverse to a longitudinal axis of the strap body and disposed within the open area between the pair of lugs for retaining the timepiece. A strap closure is includes and adapted to securely fasten the front end of the strap to the rear end of the strap, where the front end and the rear end wrap around a structural member of the weapon.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
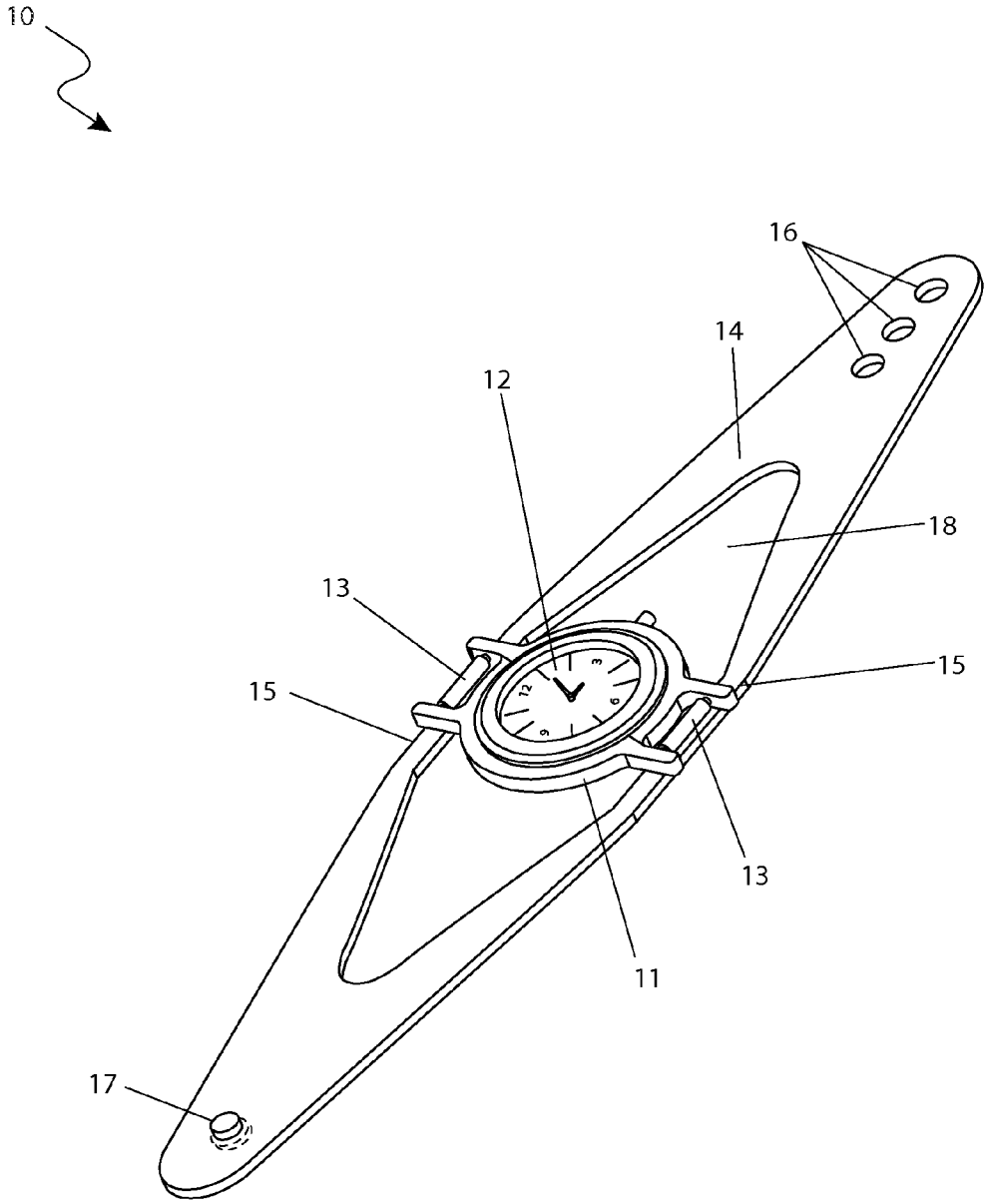
FIG. 1 is a perspective top view of a mountable timepiece 10 for hunting weapons, according to a preferred embodiment.

10 mountable timepiece
11 analog timepiece
12 analog display
13 mounting collar
14 mounting strap
15 neck
16 fastening aperture
17 fastening stud
18 cutout
19 watertight closure
20 first alternate timepiece
21 digital timepiece
22 digital display
27 spring loaded pin
30 second alternate timepiece
31 alternate first mounting strap
32 alternate second mounting strap
33 alternate mounting collar
38 first closure member
39 second closure member
60 rifle
61 butt stock
70 crossbow

80 bow
81 riser
82 arrow
83 bow string

DETAILED DESCRIPTION OF THE PREFERRED EMBODIMENT

Figure 4:
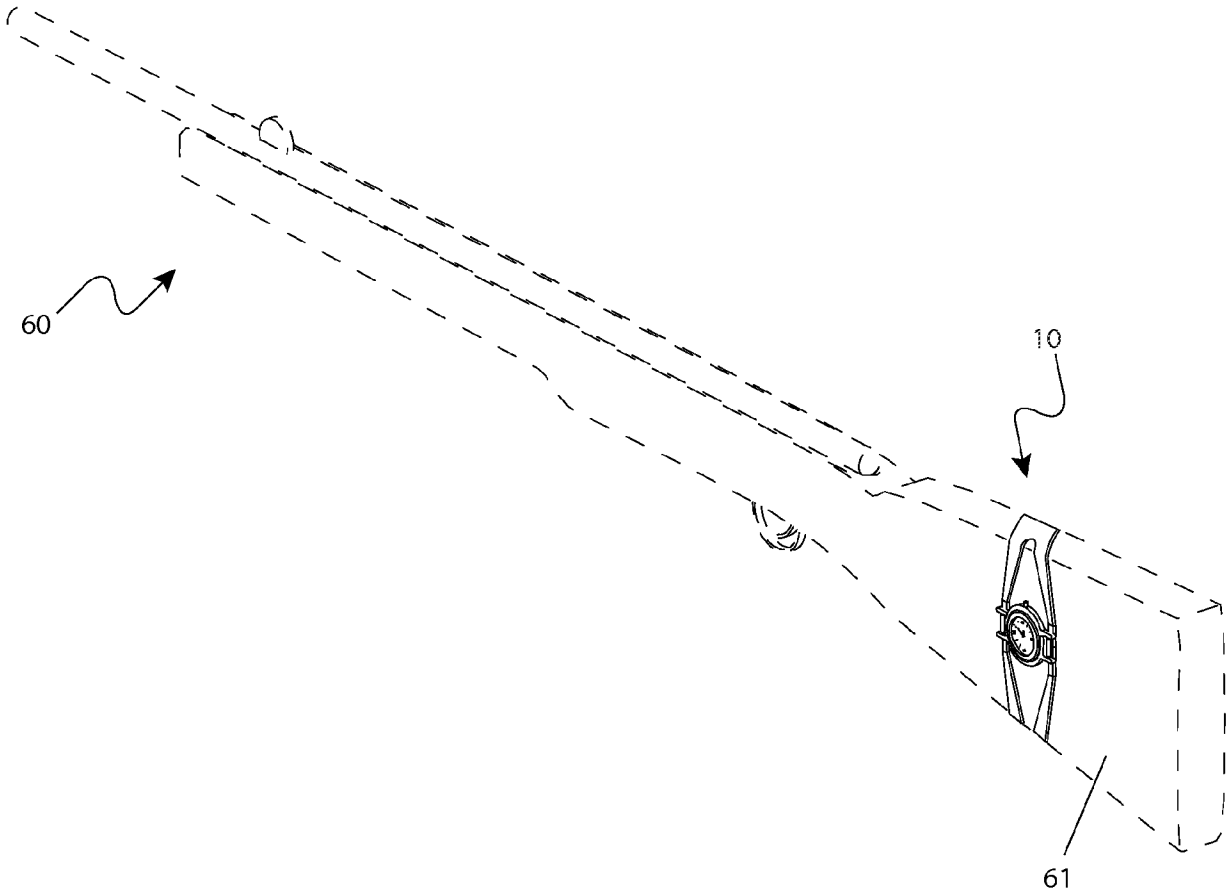
FIG. 4 is an environmental side perspective view of the mountable timepiece for hunting 10, depicted as connected to a butt stock 61 of a rifle 60, according to the preferred embodiment.
Figure 5:
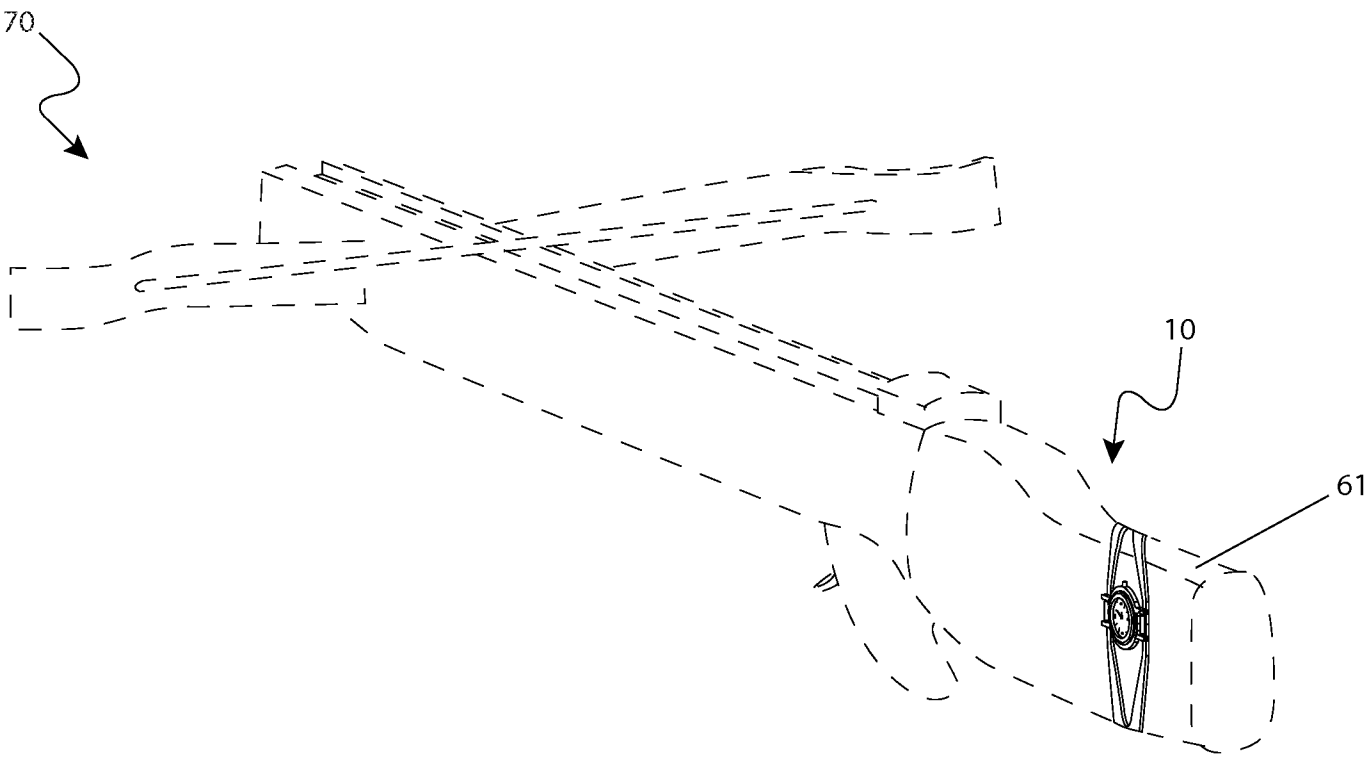
FIG. 5 is an environmental side perspective view of the mountable timepiece for hunting 10, depicted as connected to a butt stock 61 of a crossbow 70, according to the preferred embodiment.
Figure 6:
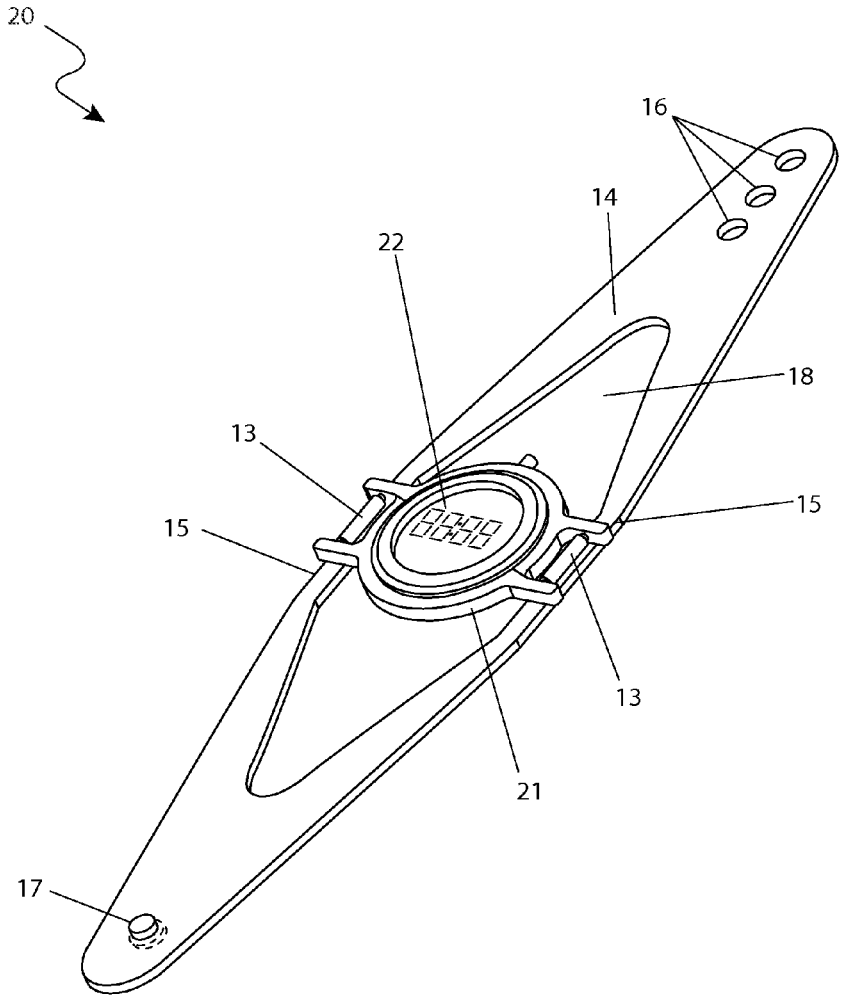
FIG. 6 is a perspective top view of a first alternate mountable timepiece 20, according to a first alternate embodiment.
Figure 7:
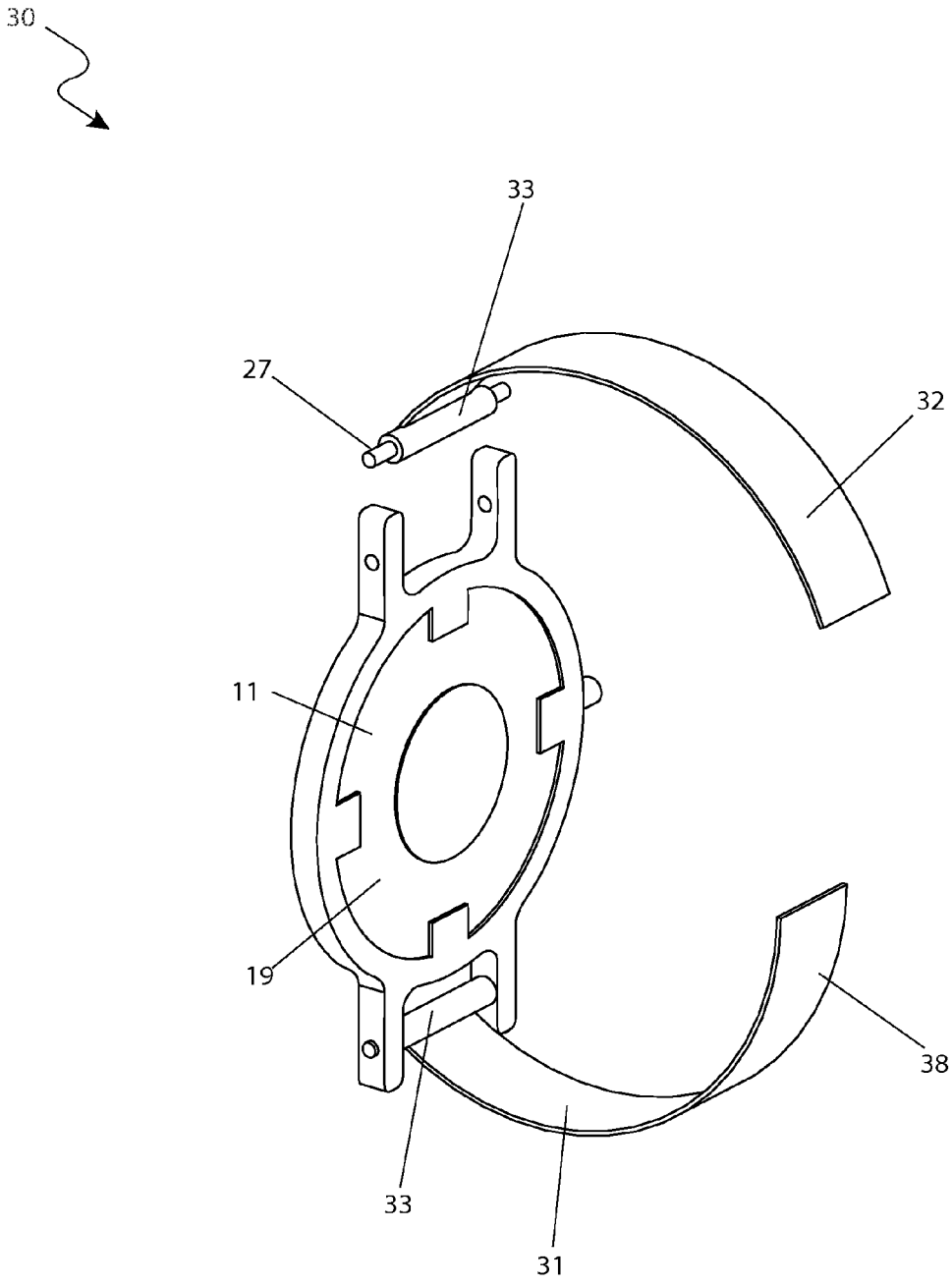
FIG. 7 is a perspective bottom view of a second alternate mountable timepiece 30, according to a second alternate embodiment; and, FIG. 8 is an environmental side perspective view of the second alternate mountable timepiece 30, depicted as connected to a riser 81 of a bow 80, according to the second alternate embodiment.
Figure 8:
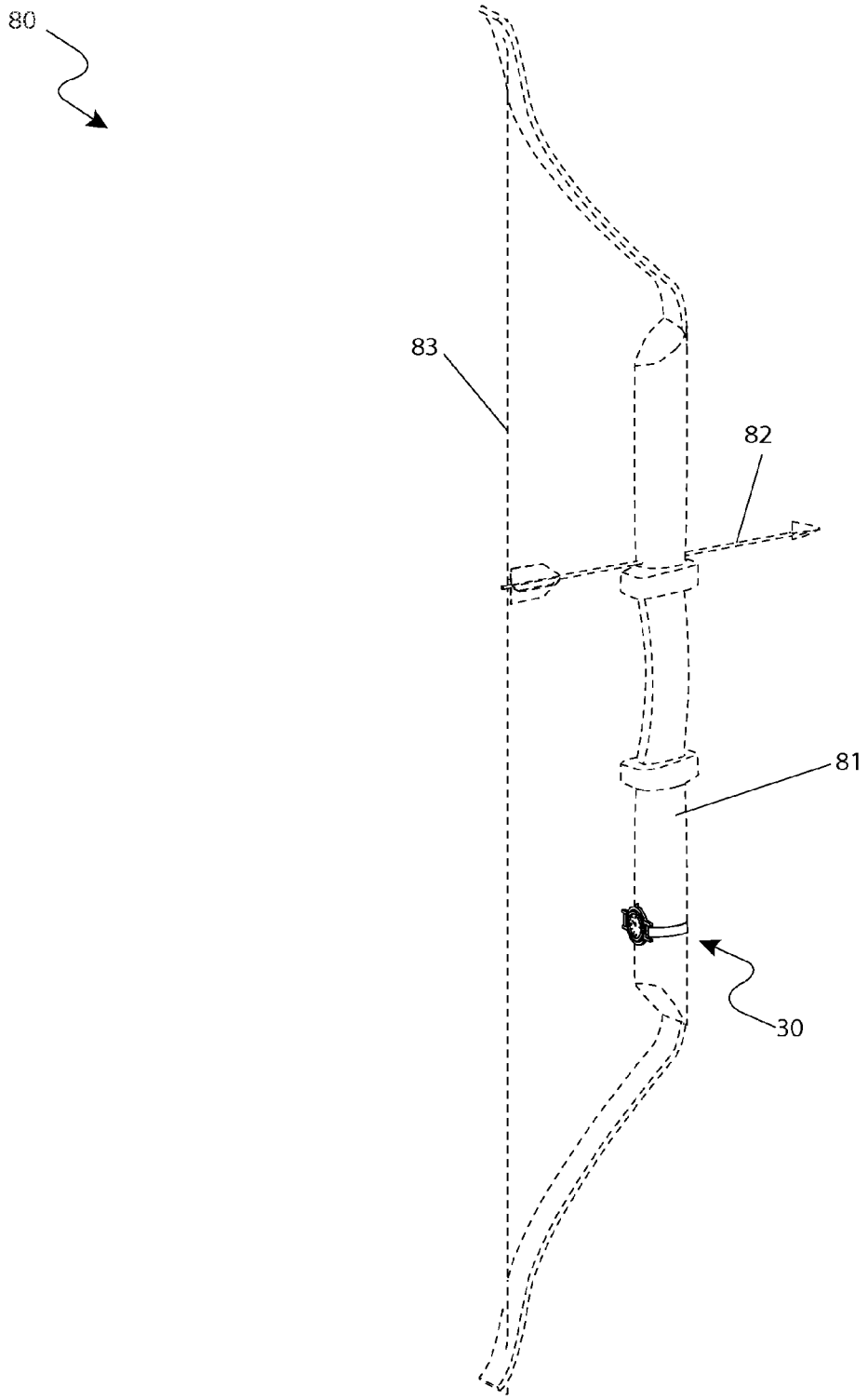

The best mode for carrying out the disclosure is presented in terms of a preferred embodiment, herein depicted within FIGS. 1 through 5 and in terms of an alternate embodiment, herein depicted within FIGS. 6 through 8. However, the disclosure is not limited to a single described embodiment and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one particular configuration may be shown and described for purposes of clarity and disclosure and not by way of limitation of scope.

The terms "a" and "an" herein do not denote a limitation of quantity, but rather denote the presence of at least one of the referenced items.

The present disclosure describes a mountable timepiece for hunting (herein described as a "device") 10, which provides for the display of the time of a day directly in a user's line of sight, thereby avoiding any rustling sounds usually associated with viewing a wrist watch or a pocket timepiece.

Figure 2:
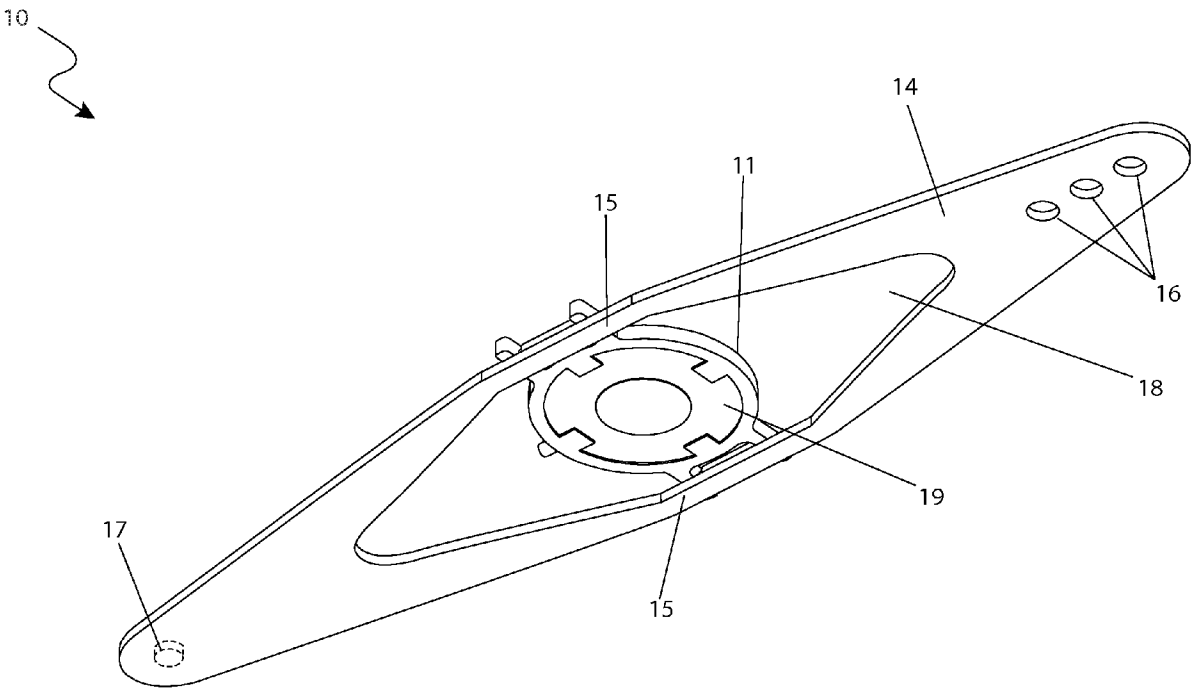
FIG. 2 is a perspective bottom view of the mountable timepiece for hunting 10, according to the preferred embodiment.

Referring now to FIG. 1, a perspective top view of the device 10; and FIG. 2, a perspective bottom view of the device 10 are disclosed. The device 10 includes an analog timepiece 11 including a glow-in-the-dark analog display 12. The device 10 further includes a mounting strap 14. The mounting strap 14 includes an end having plurality of fastening apertures 16 and a cutout 18 designed to form a longitudinal neck 15 along each side portion. An opposing end of the mounting strap 14 includes at least one (1) fastening stud 17 protruding outwardly from a top surface and the cutout 18. An upper surface portion of each neck 15 includes an integral mounting collar 13 which allows fastening the mounting strap 14 onto the analog timepiece 11 by a spring loaded pins 27 included within a core portion of each mounting collar 13. The analog timepiece 11 includes a watertight closure 19 and is fastened onto the mounting strap 14 by the pair of integral mounting collars 13 including the spring loaded pins 27. The waterproof and corrosion resistant enclosure of the timepiece 11 is envisioned to be made of materials such as, but not limited to: stainless steel, titanium, brass, or plastic.

Figure 3:
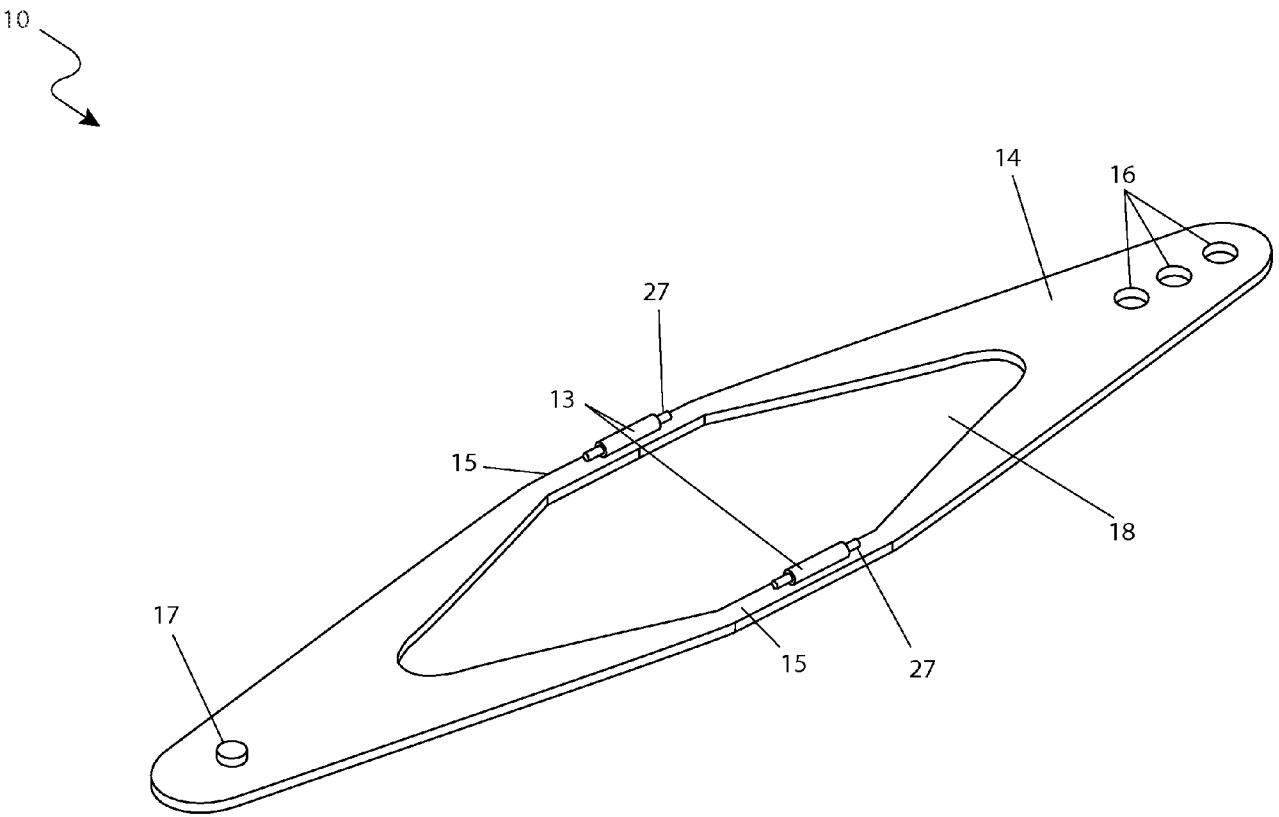
FIG. 3 is a perspective top view of a mounting strap 14 for the mountable timepiece for hunting 10, according to the preferred embodiment.

Referring now to FIG. 3, a perspective top view of the mounting strap 14 is disclosed. The mounting strap 14 includes the plurality of fastening aperture 16 and the opposing fastening stud 17, the cutout 18, and the pair of necks 15 and integral mounting collars 13 each having one spring loaded pin 27. The mounting strap 14 is envisioned to be made of elastic materials such as, but not limited to: natural rubber, synthetic rubber, or plastic. The plurality of fastening apertures 16 provide for a length adjustment, which makes the mounting of the device 10 more versatile and useful for installing onto the riser 81 of a bow 80, the butt stock 61 of a rifle 60 or crossbow 70, or onto other structural features of hunting or military weapons.

Referring now to FIG. 4, an environmental side perspective view of the device, depicted connected to butt stock 61 of the rifle 60; FIG. 5, an environmental side perspective view of the device 10, depicted connected to the butt stock 61 of a crossbow 70; are disclosed. The mounting location of the timepiece 11 is intended to provide the user with line-of-sight view of the analog display 12 in order to avoid any unintended movement resulting from viewing a wrist watch or pulling out a pocket timepiece. The depicted location of the analog timepiece 11 is intended to accommodate a right-handed user, while a left-handed user would locate the timepiece 11 on an opposite side portion of the butt stock 61. The manner and location of mounting the device 10 to the crossbow 70 is substantially similar to that of the rifle 60 mounted configurations.

Referring now to FIG. 6, a top perspective view of the first alternate mountable timepiece 20 is disclosed. This first alternate mountable timepiece 20 includes a glow-in-the-dark digital display 22 and a mounting strap 14 substantially similar to that described in the preferred embodiment of the device 10, therefore, designated by like symbols. It is envisioned that the first alternate mountable timepiece 20 is connected to the weapon in the same manner as the preferred embodiment of the device 10 as well. An alternate closure for the mounting strap 14 can include a hook-and-loop-type fastener configuration, having communicating sections of hook-and-loop-type fasteners attached to opposing end portions of the mounting strap 14 in place of the fastening apertures 16 and fastening stud 17. This alternate closure also provides for additional length adjustment which makes the mounting of the first alternate mountable timepiece 20 more versatile and useful for connection to the rifle 60 and the bow 80 or onto alternate structural members of hunting or military weapons.

Referring now to FIG. 7, a perspective bottom view of the second alternate mountable timepiece 30 is disclosed. The second alternate mountable timepiece 30 includes either the analog display 12 or the digital display 22 and a mounting configuration similar to a wrist band wherein an alternate first mounting strap 31 having an integral alternate mounting collar 33 and an alternate second mounting strap 32 having a similarly integral alternate mounting collar 33. The integral assembly of the alternate second mounting strap 32 and the corresponding alternate mounting collar 33 is depicted in a state of being removed from the time piece 11 to provide a view of the spring loaded pin 27. The alternate first mounting strap 31 and the alternate second strap 32 are fastened to each other by a first closure member 38 releasably engaging a second closure member 39. The closure members 38, 39 are envisioned to be communicating sections of hook-and-loop-type fastener, magnets, or similarly attractable materials.

Referring now to FIG. 8, an environmental side perspective view of the second alternate mountable timepiece 30 is disclosed. The second alternate mountable timepiece 30 is depicted as connected to the riser 81 of the bow 80. Closing the alternate second mounting strap 32 onto the alternate first mounting strap 31 and fastening the second closure member 39 onto the first closure member 39 securely fastens the second alternate mountable timepiece 30 around the riser 81 of the bow 80.

It is envisioned that the wrist band-like mounting configuration of the second alternate timepiece 30 can be made to be useful for the butt stock 61 installation as depicted within FIGS. 4 and 5. It is further envisioned that other styles and configurations can be easily incorporated into the teachings of the present disclosure and only one particular configuration shall be shown and described for purposes of clarity and not by way of limitation of scope.

The preferred embodiment can be utilized by the common user in a simple and effortless manner with little or no training. After initial purchase or acquisition of the device 10 in an assembled state as indicated in FIG. 1, it would be mounted as indicated in FIGS. 4 and 5.

The method of utilizing the device 10 may be achieved by performing the following steps: unpacking the device 10; setting the correct time of the day; selecting a desired weapon having a butt stock 61 to mount the device 10 thereon; selecting a user line-of-sight location on the butt stock 61 of the selected weapon; holding a first end of the mounting strap 14 in place against the butt stock 61 with a first hand; pulling a second end of the mounting strap 14 and wrapping it around the butt stock 61 with a second hand; aligning the fastening aperture 16 over the fastening stud 17; securing the fastening aperture 16 onto the fastening stud 17; after use, removing the device 10 from the butt stock 61 by performing the mounting steps in a reverse order; and, cleaning and storing the device 10.

The first alternate mountable timepiece 20 may be installed as indicated in FIGS. 4 and 5 by performing steps substantially similar to those described in the foregoing for the device 10.

The method of utilizing the second alternate mountable timepiece 30 may be achieved by performing the following steps: unpacking the timepiece 30; setting the correct time of the day; selecting a bow 80; selecting a user line-of-sight location on the riser 81 of the selected bow 80; holding an end of the first alternate mounting strap 31 in place around the riser 81 with a first hand; wrapping an end of the second alternate mounting strap 32 around the riser 81 and over the first alternate mounting strap 31 with a second hand; securely fastening the second alternate mountable timepiece 30 onto the riser 81 by means of the closure 38, 39; after use: removing the device 10 from the riser 81 by performing the mounting steps in a reverse order; and, cleaning and storing the device 10.

Steps similar to those described in the foregoing paragraph would be performed in cases where mounting the second alternate timepiece 30 configuration onto the butt stock 61 of the rifle 60, crossbow 70, or a shot gun would be a more desirable alternative.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A band for a timepiece configured for connection to a projectile weapon such that said timepiece is positioned in a line-of-sight of a user during aiming and firing of said projectile weapon, said band comprising:

a mounting strap having an elongated flexible body comprising an upper and a lower surface and a front end and an opposing rear end;

a pair of mounting collars affixed to opposing edges of said upper surface parallel to a longitudinal axis of said body for retaining said timepiece in a perpendicular orientation relative to said longitudinal axis of said body; and, a strap closure adapted to securely fasten said front end to said rear end;

wherein said front end and said rear end wrap around a structural member of said projectile weapon.

2. The band of claim 1, wherein each of said mountings collars further comprises:

a tubular member adapted to fit between a pair of opposing lugs disposed on a top and a bottom of said timepiece; and, a generally cylindrical spring bar pin disposed within said tubular member;

wherein at least a portion of each end of said spring bar pin protrudes from said tubular member for engaging said pair of opposing lugs.

3. The band of claim 1, wherein said strap closure further comprises a plurality of fastening apertures disposed longitudinally through said front end and at least one fastening stud disposed on said rear end and protruding from said upper surface;

wherein said fastening stud insertingly engages a selected one of said plurality of fastening apertures for securing said front end to said rear end when wrapped around said structural member of said projectile weapon.

4. The band of claim 1, wherein said strap closure further comprises a section of hook and loop fasteners affixed longitudinally to said lower surface of said front end and a corresponding communicative section of hook and loop fasteners affixed longitudinally to said upper surface of said rear end;

wherein said sections of hook and loop fasteners removably attach together for securing said front end to said rear end when wrapped around said structural member of said projectile weapon.

5. The band of claim 1, wherein said mounting strap comprises a length suitable to encircle said structural member of said projectile weapon, such that when said front end and said rear end wrap around said structural member said strap closure can releasably fasten said front end to said rear end.

6. The band of claim 1, wherein said mounting strap further comprises an elastic and waterproof material.

7. The band of claim 1, wherein said mounting strap further comprises an open cutout area disposed centrally to said body;

wherein said cutout area defines a pair of opposing necks extending longitudinally between said front end and said rear end.

8. The band of claim 7, wherein said pair of mounting collars is affixed to said pair of opposing necks.

9. The band of claim 8, wherein each of said mountings collars further comprises:

a tubular member fit between a pair of opposing lugs disposed on a top and a bottom of said timepiece; and, a generally cylindrical spring bar pin disposed within said tubular member;

wherein at least a portion of each end of said spring bar pin protrudes from said tubular member for engaging said pair of opposing lugs.

10. The band of claim 9, wherein said mounting strap comprises a length suitable to encircle said structural member of said projectile weapon, such that when said front end and said rear end wrap around said structural member said strap closure can releasably fasten said front end to said rear end.

11. The band of claim 10, wherein said mounting strap further comprises an elastic and waterproof material.

12. The band of claim 11, wherein said strap closure further comprises a section of hook and loop fasteners affixed longitudinally to said lower surface of said front end and a corresponding communicative section of hook and loop fasteners affixed longitudinally to said upper surface of said rear end;

wherein said sections of hook and loop fasteners removably attach together for securing said front end to said rear end when wrapped around said structural member of said projectile weapon.

13. The band of claim 11, wherein said strap closure further comprises a plurality of fastening apertures disposed longitudinally through said front end and at least one fastening stud disposed on said rear end and protruding from said upper surface;

wherein said fastening stud insertingly engages a selected one of said plurality of fastening apertures for securing said front end to said rear end when wrapped around said structural member of said projectile weapon.

14. A timepiece configured for connection to a projectile weapon such that said timepiece is positioned in a line-of-sight of a user during aiming and firing of said projectile weapon, said timepiece comprising:

a timepiece for indicating a time of day comprising at least a timepiece frame body, a watch mechanism housed within said frame body, a display, a pair of lugs disposed on opposing ends of a top side and a bottom side of said timepiece frame; wherein an open area is defined between each pair lugs;

a mounting strap having an elongated flexible body comprising an upper and a lower surface and a front end and an opposing rear end;

a pair of mounting collars affixed to opposing edges of said upper surface parallel to a longitudinal axis of said body and disposed within said open area between said pair of lugs for retaining said timepiece in a perpendicular orientation relative to said longitudinal axis of said body; and, a strap closure adapted to securely fasten said front end to said rear end;

wherein said front end and said rear end wrap around a structural member of said projectile weapon.

15. The timepiece of claim 14, wherein said mounting strap further comprises an open cutout area disposed centrally to said body;

wherein said cutout area defines a pair of opposing necks extending longitudinally between said front end and said rear end.

16. The timepiece of claim 15, wherein said pair of mounting collars is affixed to said pair of opposing necks and each of said mountings collars further comprises:

a tubular member adapted to fit between a pair of opposing lugs disposed on a top and a bottom of said timepiece; and, a generally cylindrical spring bar pin disposed within said tubular member;

wherein at least a portion of each end of said spring bar pin protrudes from said tubular member for engaging said pair of opposing lugs.

17. The timepiece of claim 16, wherein said mounting strap comprises a length suitable to encircle said structural member of said projectile weapon, such that when said front end and said rear end wrap around said structural member said strap closure can releasably fasten said front end to said rear end.

18. The timepiece of claim 17, wherein said mounting strap further comprises an elastic and waterproof material.

19. The timepiece of claim 18, wherein said strap closure further comprises a section of hook and loop fastener affixed longitudinally to said lower surface of said front end and a corresponding communicative section of hook and loop faster affixed longitudinally to said upper surface of said rear end;

wherein said sections of hook and loop fasteners removably attach together for securing said front end to said rear end when wrapped around said structural member of said projectile weapon.

20. The timepiece of claim 18, wherein said strap closure further comprises a plurality of fastening apertures disposed longitudinally through said front end and at least one fastening stud disposed on said rear end and protruding from said upper surface;

wherein said fastening stud insertingly engages a selected one of said plurality of fastening apertures for securing said front end to said rear end when wrapped around said structural member of said projectile weapon.

* * * * *